US009730276B2

(12) United States Patent
Vissa et al.

(10) Patent No.: US 9,730,276 B2
(45) Date of Patent: Aug. 8, 2017

(54) FLAT HEATING ELEMENT COMPRISING TWISTS AND BENDS AND METHOD THEREBY TO RELIEVE HEATING ELEMENT STRESS

(71) Applicants: Ramgopal Vissa, Hyderbad (IN); Venkata Burada, West Chester, OH (US); Anu Vissa, Cincinnati, OH (US)

(72) Inventors: Ramgopal Vissa, Hyderbad (IN); Venkata Burada, West Chester, OH (US); Anu Vissa, Cincinnati, OH (US)

(73) Assignee: MHI Health Devices, LLC, Cincinnati, OH (US)

( * ) Notice: Subject to any disclaimer, the term of this patent is extended or adjusted under 35 U.S.C. 154(b) by 257 days.

(21) Appl. No.: 14/541,246

(22) Filed: Nov. 14, 2014

(65) Prior Publication Data

US 2015/0136756 A1 May 21, 2015

Related U.S. Application Data

(60) Provisional application No. 61/905,949, filed on Nov. 19, 2013.

(51) Int. Cl.

| | |
|---|---|
| ***H05B 3/10*** | (2006.01) |
| ***H05B 3/24*** | (2006.01) |
| ***H05B 3/68*** | (2006.01) |
| ***H05B 3/42*** | (2006.01) |
| *H05B 3/74* | (2006.01) |

(52) U.S. Cl.

CPC ..... *H05B 3/42* (2013.01); *H05B 3/10* (2013.01); *H05B 3/24* (2013.01); *H05B 3/746* (2013.01); *H05B 3/748* (2013.01); *H05B 2203/003* (2013.01); *Y10T 29/49083* (2015.01)

(58) Field of Classification Search

None

See application file for complete search history.

(56) References Cited

U.S. PATENT DOCUMENTS

| | | | | | |
|---|---|---|---|---|---|
| 1,928,142 | A * | 9/1933 | Trent | H01C 3/10 | 338/281 |
| 2,659,800 | A * | 11/1953 | Zander | H05B 3/16 | 219/542 |
| 2,856,496 | A * | 10/1958 | Fisher | H01C 3/10 | 338/284 |
| 3,191,138 | A * | 6/1965 | Wycoff | H01C 3/14 | 219/553 |
| 4,097,714 | A * | 6/1978 | Shergov | H01J 37/065 | 219/121.27 |
| 4,321,459 | A * | 3/1982 | Miyahara | H05B 3/64 | 219/213 |
| 5,034,721 | A * | 7/1991 | Benedictus | H05B 3/24 | 219/552 |
| 2010/0193505 | A1* | 8/2010 | Peck | H05B 3/62 | 219/548 |
| 2014/0109794 | A1* | 4/2014 | Sekhar | C09D 1/00 | 106/287.1 |

* cited by examiner

*Primary Examiner* — Joseph M Pelham

(74) *Attorney, Agent, or Firm* — Michael C. Connelly

(57) ABSTRACT

Presented is a heating element, and method for producing same, comprised of strip material having a length, width and depth where the strip material is twisted at least once axially relative to its length and bent at least once across its width resulting in a generally flat profile. The twists and bends provide for expansion and contraction of the heating element and thereby provide stress relief during heating and cooling.

14 Claims, 3 Drawing Sheets

FLAT HEATING ELEMENT COMPRISING TWISTS AND BENDS AND METHOD THEREBY TO RELIEVE HEATING ELEMENT STRESS

CROSS REFERENCE TO RELATED APPLICATIONS

This patent application claims the benefit of provisional patent application Ser. No. 61/905,949, filed on Nov. 19, 2013 by the present applicants, the disclosure of which is incorporated by reference herein in its entirety.

BACKGROUND

Field

The present application is directed to a pancake style flat electrically powered heating element that withstands quick heating and cooling with maximized area of radiation surface. Also presented is a method to relieve stress related to rapid temperature change and exposure to liquids and vapor through the utilization of twists and bends in heating elements.

Prior Art

Flat heating elements bent to meet specific profiles are well known in the art. Often, such flat elements with bends are subjected to stresses upon rapid heat-up and exposure to liquids, such as water, or vapor, such as steam. These stresses may cause bowing, bending or failure of the elements. If a flat configuration is needed, the stresses may bow or warp the element from its initial flat condition. An element is needed that can withstand these stresses and retain an original configuration. It is also desirable that such elements have a maximized area of radiation surface.

SUMMARY

This application consists of a heating element comprising a strip of heating element material, the strip comprised of at least one twist and at least one bend along the length of the strip. The strip may be rectangular in cross-section, but may also be other geometric shapes such as square, triangular, round, octagonal, etc. The at least one twist and at least one bend may be configured to provide any desired two-dimensional overall element shape or profile including, but not limited to, round, rectangular or square. The element may be generally flat on one side (the top or bottom face) but the twists and bends may also provide a depth and different three-dimensional configurations.

The combination of twists and bends will help to relieve stresses caused by rapid heat-up, rapid cool-down and liquid or vapor contact. The twists and bends themselves expand and contract and may act to prevent overall deformation of the element. The twist and bend areas are provided by their geometry with room to contact or expand and may deform, but the flat surface of the element will not deform and the overall flatness and shape of the element will remain the same. Along with stress reduction or absorption, the twists also provide a surface that maximizes the radiation surface of the element. The disclosed element overcomes the common problem of breakage of heating element configurations having different section (leg) lengths.

DRAWINGS—FIGURES

DRAWINGS—REFERENCE NUMERALS

Figure 1:
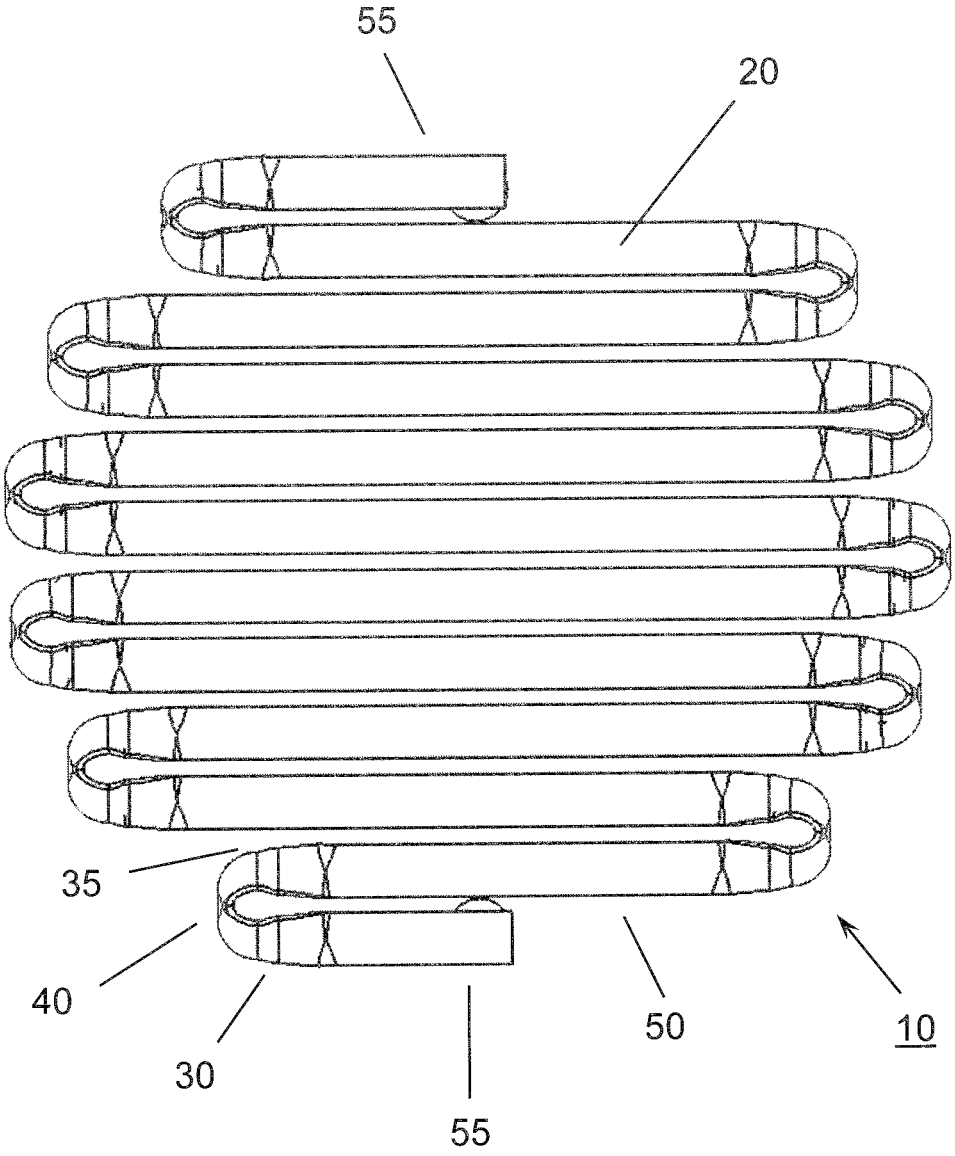
FIG. 1 is a top view of an embodiment of the flat heating element.
Figure 2:
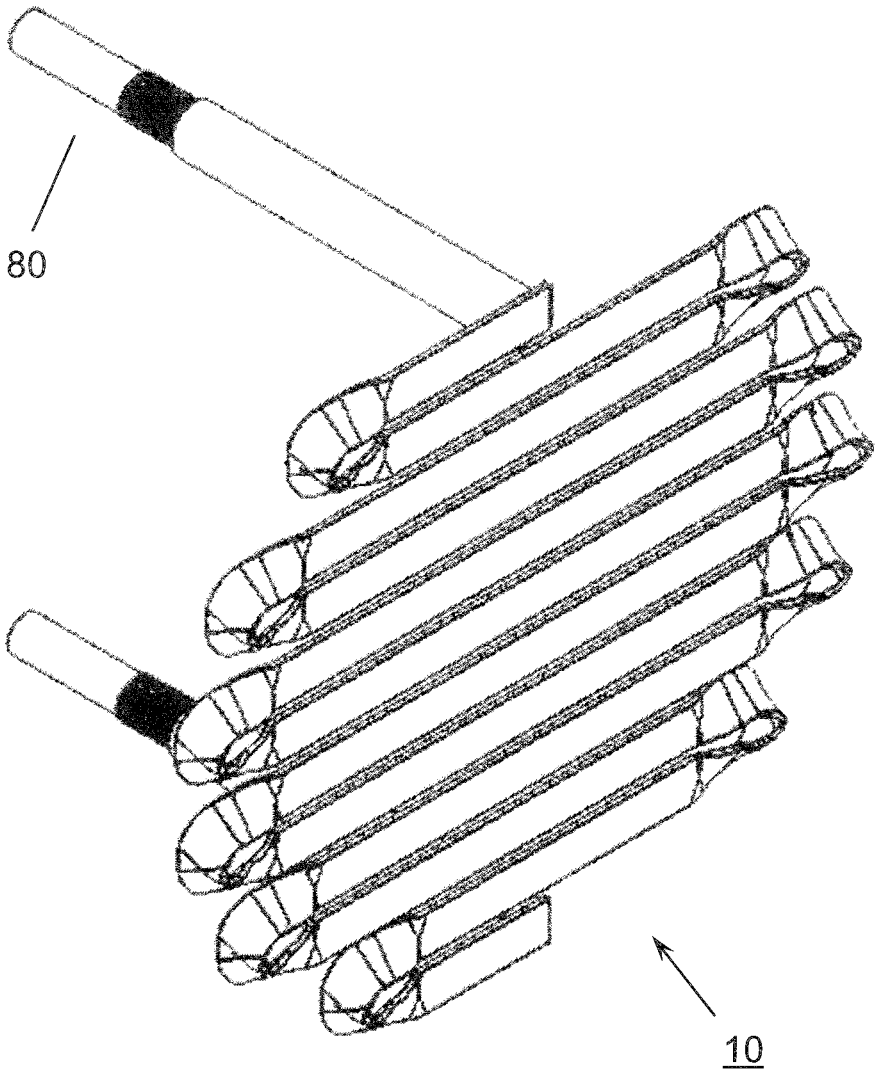
FIG. 2 is a perspective view of an embodiment of the flat heating element.
Figure 3:
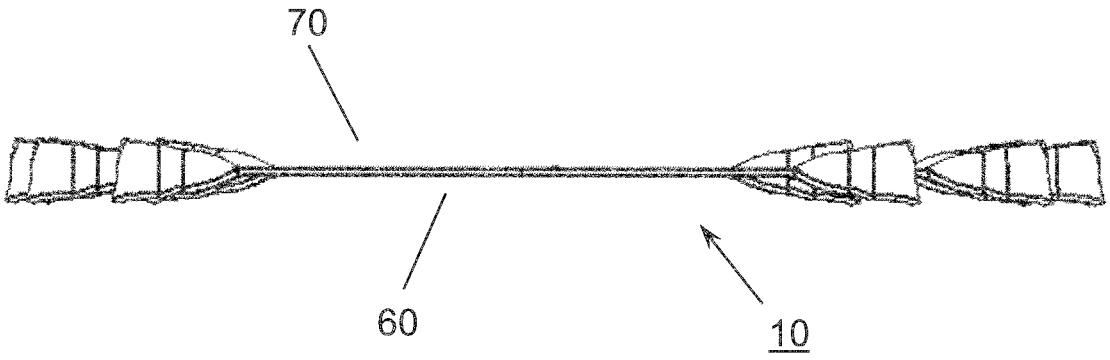
FIG. 3 is a side view of an embodiment of the flat heating element showing the twists.
Figure 4:
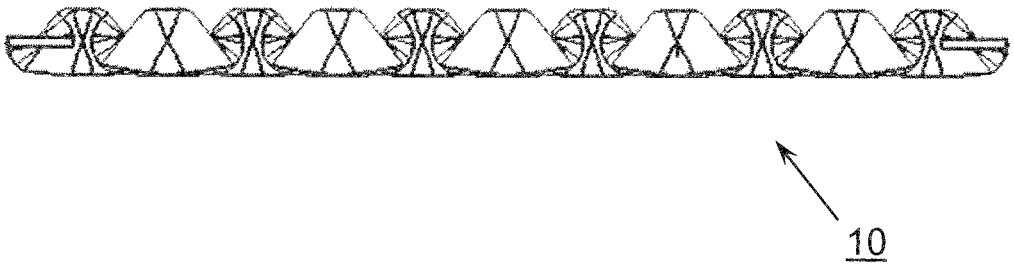
FIG. 4 is a side view 90° in relation to the side view if FIG. 3 of an embodiment of the flat heating element showing the bends.

| | |
|---|---|
| 10. flat heating element | 20. strip material |
| 30. initial twist | 35. return twist |
| 40. bend | 50. return leg |
| 55. terminal leg | 60. bottom face |
| 70. top face | 80. terminal |

DETAILED DESCRIPTION

According to FIGS. 1-4 the heating element of an embodiment 10 comprises flat strip material 20 having a length, width and depth. At a desired point from the end of the strip 20, the strip 20 is twisted counter-clockwise axially along its length at a specific angle relative to an original position)(0° of the width of the strip forming an initial twist 30. The strip is than bent across its width at a radius greater than the width of the strip 20 in a manner so that the strip forms a bend 40 and returns toward the initial twist 30. The twists and bends of the strip 20 may be performed when the strip 20 has been heated or when it is at room temperature depending on the material comprising the strip 20. After heating, the strip 20 may be allowed to air cool or may be quenched depending on the material comprising the strip 20. Jigs may be used to hold and position the strip 20 during twisting and bending. At a point in the length of the strip 20, opposite of the initial twist 30 as the strip returns towards it (at 180°), the strip 20 is twisted again, but clockwise axially along the length of the strip 20 in a return twist 35 at an angle opposite of the angle of the initial twist 30 forming a return leg 50. (For example, in a preferred embodiment, the initial twist 30 is at 90° relative to the width of the strip 20 and the return twist 35 is at −90° relative to the width of the strip 20.) Alternatively, the initial twist 30 may be clockwise and the return twist 35 may be counter-clockwise. Due to the radius of the bend 40 being greater than the width of the strip 20 and the initial twist 30 being opposite to the return twist the return leg 50 of the strip will be roughly parallel to the original terminal leg 55 without touching it and within the same plane to give a roughly flat bottom surface 60. The nearer the twists are to 90°, the flatter the bottom surface 60 will be. This bottom surface 60 may be placed upon a ceramic plate or other surface or material for support.

At a designated point past the end of the strip 20, the strip 20 is twisted again at the same angle of the initial twist 30. Then a bend 40 of a like radius is made, returning the strip 20 towards the preceding initial twist 30 where another return twist 35 at an opposite angle is made. The flat strip 20 then returns parallel to the first and second flat sections (return leg 50 and terminal leg 55) of strip 20. This process is repeated a specified number of times and with the lengths of flat strip 20 being at different lengths until the desired shape or profile is created such as the generally round profile of FIG. 1. As can be seen with FIGS. 3 and 4, the side of the element in contact with a bottom face 60 is roughly flat. The alternating initial twists 30 and return twists 35 (at 180° to each other) provide this configuration. When the twists are at 90°, the face of the element opposite the ceramic or other support surface, or top face 70, has a non-flat surface with edge, or depth face of the strip 20 at the bends 40 being above the flat width surface of the strip 20.

The element 10 is connected to a power source near each end, or terminal leg 55, by a terminal 80. The terminals 80 are connected to an appropriate electric power source not pictured. Direct connection of a power source to the terminal legs 55 is also anticipated by the applicants. As explained above, the twists 30 and bends 40 will expand and contract and relieve the stress and subsequent deformation normally suffered by the element geometry as a whole.

While the embodiment of FIG. 1 discloses a flat sided element with parallel strips in the same plane and opposing twists and 180° return radii in a round overall configuration it is anticipated that other orientations are possible and anticipated. The twists may be 90° in the same direction to create a non-flat surface on both sides. Any twist angle over 5° is anticipated. The radii may be over 180° to allow the strips to splay out and not be parallel. The radii may also be less the 180° if desired. Other two-dimensional geometrical shapes or profiles may be formed by appropriate leg lengths. Such profiles are designed to cover and provide a heat zone for a specific two-dimensional area, such as a circle as in the case of the embodiment present in FIG. 1. Three-dimensional configurations including elliptical and spherical may be created by altering the twist angles and bending the strip legs out of flat. The element may also be expandable at the bends by increasing the radius thus further splaying out the legs.

The flat surface defined by the bottom face 60 may be placed upon a ceramic or other surface to support the heating element. In other embodiments a support surface may not be necessary. A flat surface is obtained by each twist being in an opposite direction from the preceding twist (90° and −90°). In such a configuration the opposite side will not be flat.

It is anticipated, as well, that the disclosed heating element may be composed of any appropriate material capable of being formed (bent, twisted or cast, etc.) in such configurations. The flat strip material may be heated or not before twisting or bending depending on the specific material. Anticipated materials include all grades and types approved for medical use such as stainless steel, steel, T91, 304H, CC or Inconel. Other anticipated element materials include, but are not limited to, nickel-chrome (NiCr), iron-chromium-aluminum (Fe—Cr—Al), silicon carbide (SiC), molybdenum, tungsten, zirconium and molybdenum disilicide ($MoSi_2$) or any coated with colloidal alumina or Al—O or Al—O—H compounds.

The above descriptions provide examples of specifics of possible embodiments of the application and should not be used to limit the scope of all possible embodiments. Thus, the scope of the embodiments should not be limited by the examples and descriptions given, but should be determined from the claims and their legal equivalents.

We claim:

1. An electric heating element comprising a strip of material wherein the strip is comprised of a length, a width and a depth and wherein the strip comprises, at a predetermined distance, without twists, from an end of the strip, a first twist axially in line with the strip's length, through an angle greater than 0° and at most 90°; following the twist, a bend across the width of the strip; and, following the bend, a second twist in an opposite direction axially in line with the strip's length, through an angle greater than 0° and at most 90°.

2. The heating element of claim 1 wherein the angle of the first twist is at least 5°.

3. The heating element of claim 1 wherein the angle of the first twist is 90°.

4. The heating element of claim 1 wherein the at least one bend is at 180° and at a radius greater than the width of the strip.

5. The heating element of claim 1 further comprising repeating the first twist and second twist and bend in series along the length of the strip to form a desired two-dimensional profile.

6. The heating element of claim 5 wherein each of the bends in the series of bends is 180° and each of the bends is between a pair of the twists wherein the twists comprising the pair of twists are at angles opposite each other relative to the width of the strip.

7. The heating element of claim 6 wherein the angles comprising the pair of twists are 90° and −90° relative to the width of the strip.

8. The heating element of claim 1 wherein electric terminals are affixed to the strip.

9. The heating element of claim 1 wherein the strip is comprised of a material from the list consisting of stainless steel, steel, T91, 304H, CC, Inconel, nickel-chrome, iron-chromium-aluminum, silicon carbide, molybdenum, tungsten, zirconium and molybdenum disilicide.

10. The heating element of claim 1 wherein the width of the strip is larger than the depth of the strip delineating a flat cross-sectional geometry in the strip.

11. A method to relieve stress caused by dimensional change in an electric heating element comprised of a strip, the method comprising, at a predetermined distance, without twists, from an end of the strip, twisting the strip axially in line with the strip's length, through an angle greater than 0° and at most 90°; following the twist, bending the strip a across the width of the strip; and, following the bend, twisting the strip in an opposite direction axially in line with the strip's length, through an angle greater than 0° and at most 90°.

12. A method to form an electrically powered heating element comprised of a strip having a length, a width and a depth that withstands stress caused by quick heating and cooling with maximized area of radiation surface comprising, at a predetermined distance, without twists, from an end of the strip, twisting the strip axially in line with the strip's length, through an angle greater than 0° and at most 90°; following the twist, bending the strip a across the width of the strip; and, following the bend, twisting the strip axially in line with the strip's length, through an angle greater than 0° and at most 90°.

13. The method of claim 12, further comprising, heating the strip before twisting or bending the strip.

14. The method of claim 13, further comprising, affixing the strip in a jig before and during bending and twisting.

* * * * *